US012016396B2

(12) United States Patent
Du et al.

(10) Patent No.: US 12,016,396 B2
(45) Date of Patent: Jun. 25, 2024

(54) METHOD AND APPARATUS FOR CONTROLLING AN ELECTRONIC CIGARETTE, AND ELECTRONIC CIGARETTE

(71) Applicant: Shenzhen OKK Electronic Technology Co., Ltd., Shenzhen (CN)

(72) Inventors: Yuqiang Du, Shenzhen (CN); Zhiyong Yang, Shenzhen (CN)

(73) Assignee: SHENZHEN OKK ELECTRONIC TECHNOLOGY CO., LTD., Shenzhen (CN)

( * ) Notice: Subject to any disclaimer, the term of this patent is extended or adjusted under 35 U.S.C. 154(b) by 842 days.

(21) Appl. No.: 16/985,775

(22) Filed: Aug. 5, 2020

(65) Prior Publication Data

US 2021/0037890 A1 Feb. 11, 2021

(30) Foreign Application Priority Data

Aug. 9, 2019 (CN) ..... 201910736331.4

(51) Int. Cl.

| | |
|---|---|
| ***A24F 40/51*** | (2020.01) |
| ***A24F 40/46*** | (2020.01) |
| ***A24F 40/53*** | (2020.01) |
| ***A24F 40/57*** | (2020.01) |

(52) U.S. Cl.

CPC ..... *A24F 40/53* (2020.01); *A24F 40/46* (2020.01); *A24F 40/51* (2020.01); *A24F 40/57* (2020.01)

(58) Field of Classification Search

None

See application file for complete search history.

(56) References Cited

U.S. PATENT DOCUMENTS

2020/0154772 A1* 5/2020 Lim ..... A24F 40/90
2020/0323270 A1* 10/2020 Chen ..... A24F 40/40

FOREIGN PATENT DOCUMENTS

| | | |
|---|---|---|
| CN | 207744710 | 8/2018 |
| CN | 108851233 | 11/2018 |
| CN | 110062587 | 7/2019 |

OTHER PUBLICATIONS

Chinese Office Action dated Dec. 2, 2020 In Corresponding Chinese Patent Application No. 201910736331.4.

* cited by examiner

*Primary Examiner* — Katherine A Will

(74) *Attorney, Agent, or Firm* — DUANE MORRIS LLP

(57) ABSTRACT

Provided are a method and apparatus for controlling an electronic cigarette, and an electronic cigarette. When a trigger signal is received, the electronic cigarette is initiated, a heating temperature of a heat generating sheet of the electronic cigarette is controlled to be a first temperature, and the heat generating sheet enters a low-temperature heating state; when it is determined that no cartridge exists in a cigarette pocket of the electronic cigarette, the heating temperature of the heat generating sheet is controlled to be maintained at the first temperature which cannot combust a flammable substance, thereby when the electronic cigarette is carried, avoiding safety hazards of a fire brought by an unintentional trigger of an initiation switch in case a flammable substance is brought into contact with the heating element of the electronic cigarette, and improving the usage safety of the electronic cigarette.

4 Claims, 5 Drawing Sheets

METHOD AND APPARATUS FOR CONTROLLING AN ELECTRONIC CIGARETTE, AND ELECTRONIC CIGARETTE

CROSS-REFERENCE TO RELATED APPLICATIONS

This application claims priority to Chinese Patent Application No. 201910736331.4 filed on Aug. 9, 2019, the disclosure of which is incorporated herein by reference in its entirety.

TECHNICAL FIELD

Embodiments of the present disclosure relate to the technology of electronic cigarettes and, in particular, to a method and apparatus for controlling an electronic cigarette, and an electronic cigarette.

BACKGROUND

A heating non-combustion electronic cigarette is generally composed of a battery, a heater and a cartridge. Tobacco in the cartridge is cured by the heater so that the tobacco is cured enough to emit flavor instead of being combusted, thus smoke is generated for a user smoking. The heating non-combustion electronic cigarette not only retains a pure taste of a traditional cigarette but also avoids health hazards to the user caused by particles and harmful substances (tar, etc.) generated in a case of combusting the tobacco at a high temperature, thus this kind of electronic cigarette is widely popular with users.

Under normal circumstances, when the electronic cigarette is used, the user presses a button to turn on the electronic cigarette, and a heating element starts to generate heat. After the cartridge is inserted, the user can use the electronic cigarette normally. However, when the user carries the electronic cigarette, the electronic cigarette is easily triggered by mistake to enter a working state. In case a flammable substance is brought into contact with the heating element of the electronic cigarette at this time, a fire may be caused, and safety hazards are posed.

It can be seen that electronic cigarettes in the related art are easily triggered to generate heat without the cartridge, which poses major safety hazards.

SUMMARY

The present disclosure provides a method and apparatus for controlling an electronic cigarette, and an electronic cigarette, to avoid heating triggered without a cartridge and improve usage safety of the electronic cigarette.

In an embodiment, the present disclosure provides a method for controlling an electronic cigarette. The method includes steps described below.

A trigger signal is received, and based on the trigger signal, a heating temperature of a heat generating sheet of the electronic cigarette is controlled to be a first temperature.

It is detected whether a cartridge exists in a cigarette pocket of the electronic cigarette.

When it is determined that no cartridge exists in the cigarette pocket, the heating temperature of the heat generating sheet is controlled to be maintained at the first temperature; where the first temperature is lower than a second temperature, and the second temperature is a heating temperature of the heat generating sheet when a user smokes the electronic cigarette.

Alternatively, the method further includes a step described below.

When it is determined that the cartridge exists in the cigarette pocket, the heating temperature of the heat generating sheet is controlled to be the second temperature.

Alternatively, the step in which it is detected whether the cartridge exists in the cigarette pocket of the electronic cigarette includes steps described below.

A temperature value of the heat generating sheet is detected.

When the temperature value decreases, it is determined that the cartridge is inserted into the cigarette pocket of the electronic cigarette.

Alternatively, the step in which it is detected whether the cartridge exists in the cigarette pocket of the electronic cigarette includes steps described below.

The heating temperature of the heat generating sheet is controlled to be increased to a third temperature, and a temperature variation curve of the heat generating sheet is acquired, where the third temperature is lower than the second temperature.

When the temperature variation curve extends, it is determined that the cartridge exists in the cigarette pocket.

Alternatively, the method further includes a step described below.

When it is determined that a duration in which no cartridge exists in the cigarette pocket is greater than a preset duration, the heat generating sheet is controlled to stop heating.

Alternatively, the electronic cigarette includes a prompt device, which is controlled to send out a prompt when receiving the trigger signal.

In an embodiment, the present disclosure provides an apparatus for controlling an electronic cigarette. The apparatus includes a first control module, a detection module and a maintenance module.

The first control module is configured to receive a trigger signal, and control, based on the trigger signal, a heating temperature of a heat generating sheet of the electronic cigarette to be a first temperature.

The detection module is configured to detect whether a cartridge exists in a cigarette pocket of the electronic cigarette.

The maintenance module is configured to control the heating temperature of the heat generating sheet to be maintained at the first temperature, when it is determined that no cartridge exists in the cigarette pocket; where the first temperature is lower than a second temperature, and the second temperature is a heating temperature of the heat generating sheet when a user smokes the electronic cigarette.

Alternatively, the apparatus further includes a second temperature control module.

The second temperature control module is configured to control the heating temperature of the heat generating sheet to be the second temperature, when it is determined that the cartridge exists in the cigarette pocket.

Alternatively, the detection module includes a temperature detection unit and a first cartridge determination unit.

The temperature detection unit is configured to detect a temperature value of the heat generating sheet.

The first cartridge determination unit is configured to determine that the cartridge is inserted into the cigarette pocket of the electronic cigarette, when the temperature value decreases.

Alternatively, the detection module includes a heat generation control unit, a temperature curve acquisition unit and a second cartridge determination unit.

The heat generation control unit is configured to control the heating temperature of the heat generating sheet to be increased to a third temperature.

The temperature curve acquisition unit is configured to acquire a temperature variation curve of the heat generating sheet, and the third temperature is lower than the second temperature.

The second cartridge determination unit is configured to determine that the cartridge exists in the cigarette pocket, when the temperature variation curve extends.

Alternatively, when it is determined that a duration in which no cartridge exists in the cigarette pocket is greater than a preset duration, the heat generation control unit controls the heat generating sheet to stop heating.

Alternatively, the electronic cigarette includes a prompt device, and the apparatus further includes a prompt module configured to control the prompt device to send out a prompt when receiving the trigger signal.

In an embodiment, the present disclosure provides an electronic cigarette including a cap of a cigarette pocket, a heat generating sheet and a control component.

The cap of the cigarette pocket is disposed on a shell of the electronic cigarette, and configured to send out a trigger signal.

The heat generating sheet is disposed inside a cigarette pocket of the electronic cigarette, and configured to generate heat.

The control component is electrically connected to the heat generating sheet, and the control component is configured to: after receiving the trigger signal, detect whether a cartridge exists in the cigarette pocket of the electronic cigarette, and when it is determined that no cartridge exists in the cigarette pocket, control a heating temperature of the heat generating sheet to be maintained at a first temperature; where the first temperature is lower than a second temperature, and the second temperature is a heating temperature of the heat generating sheet when a user smokes the electronic cigarette.

Alternatively, the shell of the electronic cigarette is provided with a slide rail, and the cap of the cigarette pocket is disposed on the slide rail to move along a slide groove of the slide rail.

When the cap of the cigarette pocket slides to a preset position of the slide rail, a notch of the cigarette pocket is covered.

Alternatively, a first induction component is disposed on a side of the cap of the cigarette pocket facing towards the electronic cigarette, and a second induction component is disposed in the electronic cigarette.

During the cap of the cigarette pocket sliding on the slide rail, the trigger signal is generated when a position of the first induction component corresponds to a position of the second induction component to induct with each other.

In an embodiment, the present disclosure provides an electronic cigarette including an upper shell, a lower shell, a heat generating sheet and a control component.

The upper shell and the lower shell are rotatable relative to each other around a common rotation axis to generate a trigger signal.

The heat generating sheet is disposed inside a cigarette pocket of the electronic cigarette, and configured to generate heat.

The control component is electrically connected to the heat generating sheet, and configured to: after receiving the trigger signal, detect whether a cartridge exists in the cigarette pocket of the electronic cigarette, and when it is determined that no cartridge exists in the cigarette pocket, control a heating temperature of the heat generating sheet to be maintained at a first temperature; where the first temperature is lower than a second temperature, and the second temperature is a heating temperature of the heat generating sheet when a user smokes the electronic cigarette.

Alternatively, the electronic cigarette further includes an upper cover bracket, a first trigger member and a second trigger member, where the upper shell is sleeved on the upper cover bracket, a gap exists between the upper shell and the upper cover bracket, the first trigger member is disposed in the gap, and the second trigger member, in correspondence to the first trigger member, is disposed on the lower shell.

When the upper shell rotates relative to the lower shell, the first trigger member or the second trigger member generates the trigger signal.

Alternatively, the first trigger member includes a magnet or an optical signal transmitter.

The second trigger member includes a Hall sensor or an optical signal receiver.

Alternatively, the upper shell and the lower shell rotate relative to each other around the common rotation axis by a specified angle to generate the trigger signal corresponding to the specified angle, and the control component is configured to select, according to the trigger signal, a heating curve corresponding to the specified angle to control the heat generating sheet to heat according to the heating curve.

Alternatively, the electronic cigarette further includes a return member, which is disposed between the upper shell and the lower shell to enable the upper shell to return to an initial position after the upper shell rotates relative to the lower shell.

In the technical schemes provided by the embodiments of the present disclosure, when the trigger signal is received, the electronic cigarette is initiated, the heating temperature of the heat generating sheet of the electronic cigarette is controlled to be the first temperature, and the heat generating sheet enters a low-temperature heating state; when it is determined that no cartridge exists in the cigarette pocket of the electronic cigarette, the heating temperature of the heat generating sheet is controlled to be maintained at the first temperature which cannot combust a flammable substance, thereby avoiding safety hazards of a fire brought by an unintentional trigger of an initiation switch in case the flammable substance is brought into contact with a heating element of the electronic cigarette when the electronic cigarette is carried, and improving the usage safety of the electronic cigarette.

Figure 1:
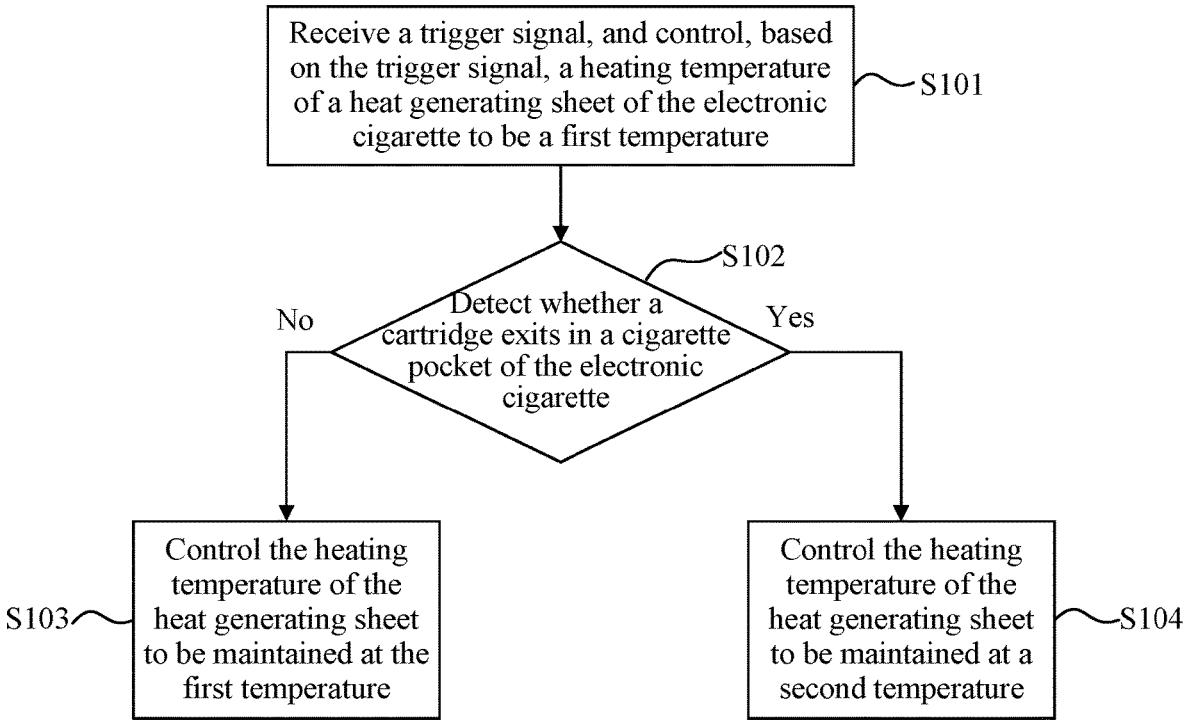
FIG. 1 is a flowchart of a method for controlling an electronic cigarette according to an embodiment one of the present disclosure.

1. Cap of a cigarette pocket; 2. Heat generating sheet; 3. Control component; 4. Shell; 5. Slide rail; 6. First induction component; 7. Second induction component; 8. Battery component; 9. Cigarette pocket; 10. Fixing member; 11. Cavity; 12. Vibration motor; 13. Magnet;

21. Upper shell; 22. Lower shell; 23. Heat generating sheet; 24. Control component; 25. Cigarette pocket; 26. Upper cover bracket; 27. First trigger member; 28. Second trigger member; 29. Battery component.

DETAILED DESCRIPTION

Hereinafter the present disclosure is further described in detail in conjunction with the drawings and embodiments. It is to be understood that the embodiments set forth below are intended to illustrate and not to limit the present disclosure. Additionally, it is to be noted that for ease of description, only part, not all, of the structures related to the present disclosure are illustrated in the drawings.

Embodiment One

The embodiment one of the present disclosure provides a method for controlling an electronic cigarette. FIG. 1 is a flowchart of a method for controlling an electronic cigarette according to the embodiment one of the present disclosure. This embodiment may be applied to control a heating non-combustion electronic cigarette and the method may be performed by an apparatus for controlling an electronic cigarette in an embodiment of the present disclosure. This apparatus may be implemented in a form of software and/or hardware and integrated into the electronic cigarette. As shown in FIG. 1, the method includes steps described below.

In S101, a trigger signal is received, and based on the trigger signal, a heating temperature of a heat generating sheet of the electronic cigarette is controlled to be a first temperature.

Exemplarily, the trigger signal is an initiation signal, and when the initiation signal is received, the heating temperature of the heat generating sheet of the electronic cigarette is controlled to be the first temperature. In an embodiment of the present disclosure, the electronic cigarette is the heating non-combustion electronic cigarette. When a user smokes, the heat generating sheet cures tobacco in a cartridge to a second temperature instead of combusting the tobacco, where the second temperature is a temperature enough for the tobacco to emit flavor and generally in a range of 250° C. to 450° C., so as to avoid health hazards to the user by harmful substances (tar) and particles generated in a case of combusting the tobacco at a high temperature.

In S102, it is detected whether a cartridge exists in a cigarette pocket of the electronic cigarette.

Exemplarily, in one embodiment of the present disclosure, whether the cartridge exists in the cigarette pocket of the electronic cigarette may be detected by a method described below.

After the heating temperature of the heat generating sheet of the electronic cigarette is controlled to be the first temperature based on the trigger signal, a temperature value of the heat generating sheet is detected in real time. When the cartridge is inserted into the cigarette pocket, the temperature of the heat generating sheet will have a certain decrease. By configuration of a certain decrease threshold, when the temperature value of the heat generating sheet decreases, and this decreased value exceeds the decrease threshold, it is determined that the cartridge is inserted into the cigarette pocket of the electronic cigarette. The decrease threshold may be obtained through multiple experiments in advance. When the temperature value of the heat generating sheet is maintained at the first temperature, or a temperature variation value of the heat generating sheet is less than or equal to the decrease threshold, it is determined that no cartridge exists in the cigarette pocket of the electronic cigarette.

Exemplarily, in another embodiment of the present disclosure, whether the cartridge exists in the cigarette pocket of the electronic cigarette may be detected by a method described below.

After the heating temperature of the heat generating sheet of the electronic cigarette is controlled to be the first temperature based on the trigger signal, the heating temperature of the heat generating sheet is controlled to be increased to a third temperature, where the third temperature is lower than the second temperature. Exemplarily, the third temperature may be any temperature between 120° C. to 150° C. This temperature range is lower than an ignition point of a flammable substance. During this heating period, a temperature variation curve of the heat generating sheet is acquired. If the cartridge exists in the cigarette pocket of the electronic cigarette, the time for the heat generating sheet to be increased from the first temperature to the third temperature will extend, that is, the temperature variation curve will extend, so that it may be determined that the cartridge exists in the cigarette pocket of the electronic cigarette. If no cartridge exists in the cigarette pocket of the electronic cigarette, the time for the heat generating sheet to be increased from the first temperature to the third temperature is unchanged, so that it may be determined that no cartridge exists in the cigarette pocket of the electronic cigarette. When it is determined that no cartridge exists in the cigarette pocket, S103 is executed; and when it is determined that the cartridge exists in the cigarette pocket, S104 is executed.

In S103, the heating temperature of the heat generating sheet is controlled to be maintained at the first temperature.

The first temperature is lower than the second temperature. Exemplarily, the first temperature may be any temperature between a normal temperature to 100. This temperature range is lower than the ignition point of the flammable substance. Even if the heat generating sheet contacts with a flammable substance, safety hazards of a fire will not be caused.

When the cartridge is inserted into the electronic cigarette and the user smokes the electronic cigarette, the cartridge generally needs to be pre-heated in certain time. Preferably, when the user inserts the cartridge, to reduce time for preheating the cartridge, the first temperature may be set to be within a range of 85° C. to 100° C., so that when the user inserts the cartridge, the heat generating sheet can quickly heat to the second temperature.

In S104, the heating temperature of the heat generating sheet is controlled to be the second temperature.

Exemplarily, when it is detected that the cartridge is inserted into the cigarette pocket, the heat generating sheet is controlled to heat to the second temperature, where the second temperature is generally within a range of 250° C. to 450° C. This temperature range is enough to heat the tobacco in the cartridge to emit flavor for the user to smoke, instead of being combusted.

Alternatively, in an embodiment of the present disclosure, when it is determined that no cartridge exists in the cigarette pocket, and a duration in which no cartridge exists in the cigarette pocket is greater than a preset duration, the heat generating sheet is controlled to stop heating. Exemplarily, the preset duration may be 2 minutes. In this way, wastes of battery energy of the electronic cigarette because of a long time non-usage of the electronic cigarette by a user are avoided, and the lifetime of the electronic cigarette is improved.

Alternatively, the electronic cigarette includes a prompt device. When the trigger signal is received, the prompt device is controlled to send out a prompt to prompt the user that the electronic cigarette has been initiated. If the trigger signal is triggered by the user by mistake, the user may turn off the trigger signal according to the prompt. Exemplarily, the prompt device may be an LED light, and the user is prompted that the electronic cigarette has been initiated through flashes of the LED light. The prompt device may also be a vibration motor, and the user is prompted that the electronic cigarette has been initiated through variations. In other embodiments of the present disclosure, the prompt device may also be a buzzer or a speaker, which emits sounds to prompt the user that the electronic cigarette has been initiated.

Figure 2:
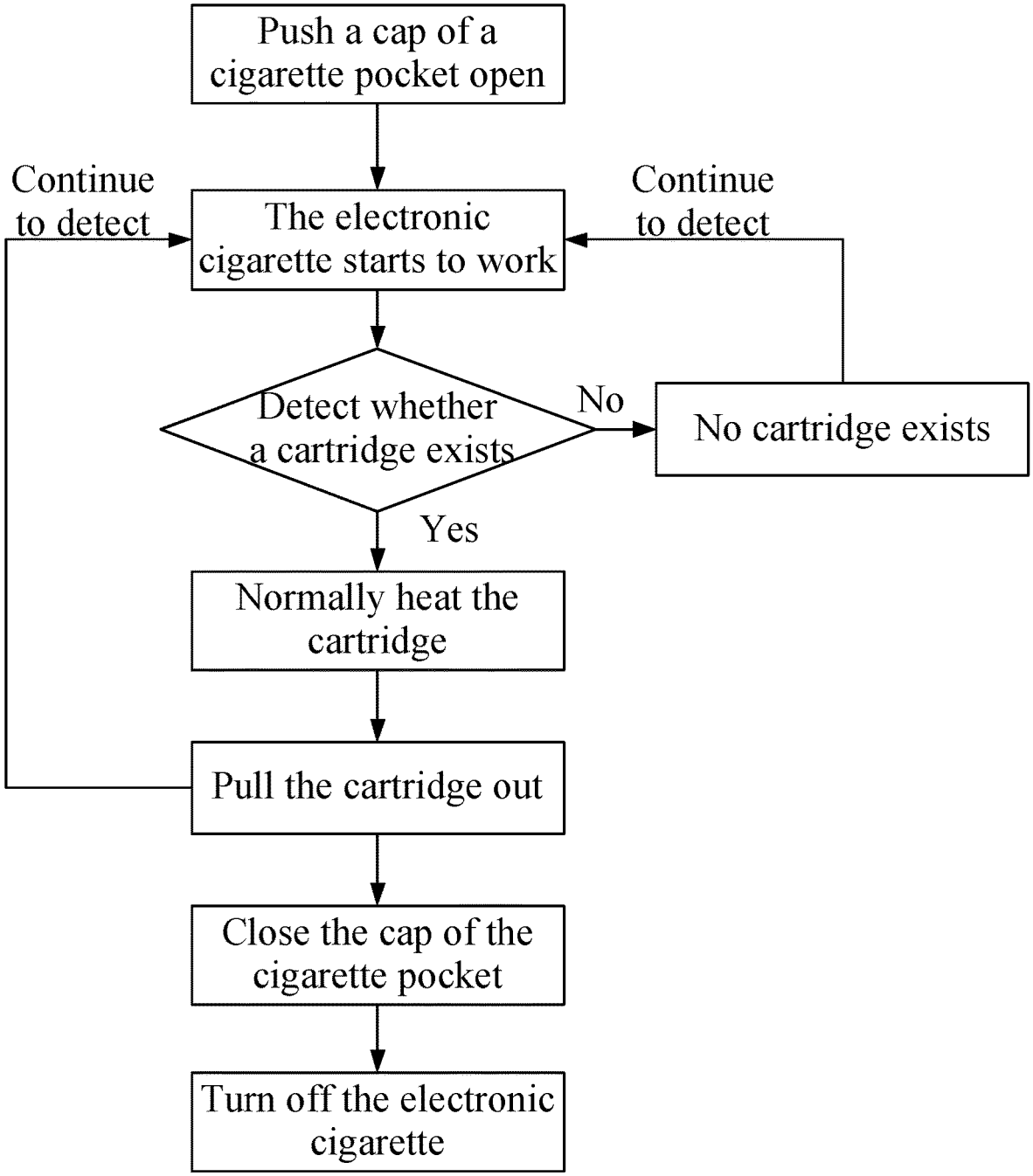
FIG. 2 is a logic schematic diagram of a method for controlling an electronic cigarette according to an embodiment one of the present disclosure.

FIG. 2 is a logic schematic diagram of a method for controlling an electronic cigarette according to an embodiment of the present disclosure. Referring to FIG. 2, when the user smokes the electronic cigarette, a cap of the cigarette pocket is pushed open, and a control component receives the trigger signal and controls the electronic cigarette to start to work; the control component controls the heating temperature of the heat generating sheet to be the first temperature, and then detects whether a cartridge exists in the cigarette pocket; when no cartridge exists, the step in which the electronic cigarette starts to work is controlled to be re-executed; if the cartridge exists in the cigarette pocket, the control component controls the heating temperature of the heat generating sheet to heat the cartridge by the second temperature, so that the cartridge is atomized. The user smokes through a mouthpiece, when the user finishes smoking, the cartridge is pulled out; if the cap of the cigarette pocket is not closed, the step in which the electronic cigarette starts to work is returned to be re-executed; if the cap of the cigarette pocket is closed, the electronic cigarette is in a standby state; and if the user presses an off button, the electronic cigarette is turned off.

In the technical schemes provided by the embodiments of the present disclosure, when the trigger signal is received, the electronic cigarette is initiated, the heating temperature of the heat generating sheet of the electronic cigarette is controlled to be the first temperature, and the heat generating sheet enters a low-temperature heating state; when it is determined that no cartridge exists in the cigarette pocket of the electronic cigarette, the heating temperature of the heat generating sheet is controlled to be maintained at the first temperature which cannot combust the flammable substance, thereby when the electronic cigarette is carried, avoiding safety hazards of a fire brought by an unintentional trigger of an initiation switch in case a flammable substance is brought into contact with the heating element of the electronic cigarette, and improving usage safety of the electronic cigarette.

Embodiment Two

Figure 3:
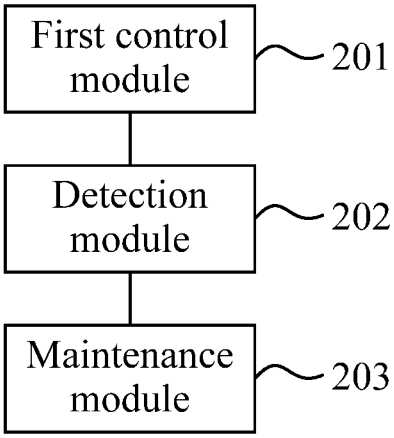
FIG. 3 is a structural diagram of an apparatus for controlling an electronic cigarette according to an embodiment two of the present disclosure.

The embodiment two of the present disclosure provides an apparatus for controlling an electronic cigarette. FIG. 3 is a structural diagram of an apparatus for controlling an electronic cigarette according to the embodiment two of the present disclosure. As shown in FIG. 3, the apparatus for controlling the electronic cigarette includes a first control module 201, a detection module 202 and a maintenance module 203.

The first control module 201 is configured to receive a trigger signal, and control, based on the trigger signal, a heating temperature of a heat generating sheet of the electronic cigarette to be a first temperature.

The detection module 202 is configured to detect whether a cartridge exists in a cigarette pocket of the electronic cigarette.

The maintenance module 203 is configured to control the heating temperature of the heat generating sheet to be maintained at the first temperature, when it is determined that no cartridge exists in the cigarette pocket; where the first temperature is lower than a second temperature, and the second temperature is a heating temperature of the heat generating sheet when a user smokes the electronic cigarette.

Alternatively, the apparatus further includes a second temperature control module.

The second temperature control module is configured to: when it is determined that the cartridge exists in the cigarette pocket, control the heating temperature of the heat generating sheet to be the second temperature.

Alternatively, the detection module 202 includes a temperature detection unit and a first cartridge determination unit.

The temperature detection unit is configured to detect a temperature value of the heat generating sheet.

The first cartridge determination unit is configured to determine that the cartridge is inserted into the cigarette pocket of the electronic cigarette, when the temperature value decreases.

Alternatively, the detection module 202 includes a heat generation control unit, a temperature curve acquisition unit and a second cartridge determination unit.

The heat generation control unit is configured to control the heating temperature of the heat generating sheet to increase to a third temperature.

The temperature curve acquisition unit is configured to acquire a temperature variation curve of the heat generating sheet, where the third temperature is lower than the second temperature.

The second cartridge determination unit is configured to determine that the cartridge exists in the cigarette pocket, when the temperature variation curve extends.

Alternatively, when it is determined that a duration in which no cartridge exists in the cigarette pocket is greater than a preset duration, the heat generation control unit controls the heat generating sheet to stop heating.

Alternatively, the electronic cigarette includes a prompt device, and the apparatus further includes a prompt module configured to control the prompt device to send out a prompt when receiving the trigger signal.

The above-mentioned apparatus for controlling an electronic cigarette may perform the method for controlling an electronic cigarette according to any one of the embodiments of the present disclosure, and has functional modules and beneficial effects corresponding to the execution of the method.

Embodiment Three

Figure 4:
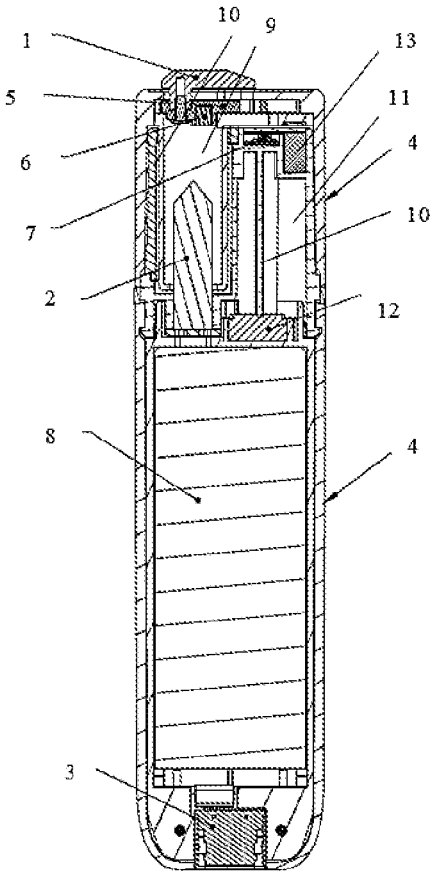
FIG. 4 is a schematic diagram of an internal structure of an electronic cigarette according to an embodiment three of the present disclosure.

FIG. 4 is a schematic diagram of an internal structure of an electronic cigarette according to the embodiment three of the present disclosure. As shown in FIG. 4, the electronic cigarette includes a cap 1 of a cigarette pocket, a heat generating sheet 2 and a control component 3.

The cap 1 of the cigarette pocket is disposed on a shell 4 of the electronic cigarette, and configured to send out a trigger signal for the control component 3 to control a heating temperature of the heat generating sheet 2 to be a first temperature. The heat generating sheet 2 is disposed inside the cigarette pocket 9 of the electronic cigarette, and configured to generate heat. The control component 3 is electrically connected to the heat generating sheet 2, and configured to: after receiving the trigger signal, detect whether a cartridge is inserted into the cigarette pocket 9 of the electronic cigarette, and when it is determined that no cartridge exists in the cigarette pocket 9, control the heating temperature of the heat generating sheet 2 to be maintained at the first temperature; where the first temperature is lower than a second temperature, and the second temperature is a heating temperature of the heat generating sheet 2 when a user smokes the electronic cigarette. In the embodiments of the present disclosure, the electronic cigarette is a heating non-combustion electronic cigarette. When the user smokes, the heat generating sheet cures tobacco in the cartridge to the second temperature instead of combusting the tobacco, where the second temperature is a temperature enough for the tobacco to emit flavor and generally within a range of 250° C. to 450° C., so as to avoid health hazards to the user caused by harmful substances (tar) and particles generated in a case of combusting the tobacco at a high temperature. The first temperature is lower than the second temperature. Exemplarily, the first temperature may be any temperature between a normal temperature to 100. This temperature range is lower than an ignition point of a flammable substance. Even if the heat generating sheet contacts with a flammable substance, safety hazards of a fire will not be caused. A method for detecting whether the cartridge is inserted into the cigarette pocket 9 of the electronic cigarette has been described in detail in the embodiment one of the present disclosure, which will not be repeated here.

The heat generating sheet 2 may be any one of a positive temperature coefficient thermistor, a negative temperature coefficient thermistor or the like, and the control component 3 may be any one of an integrated circuit board, a printed circuit board, a control chip or the like.

Exemplarily, the cap 1 of the cigarette pocket in this embodiment may be configured to send out the trigger signal. When the cap 1 of the cigarette pocket of the electronic cigarette is pushed open, the trigger signal is sent out, the electronic cigarette is in an initiated state, when the control component 3 detects the initiated state, the control component 3 controls the heating temperature of the heat generating sheet 2 to be the first temperature for performing the low-temperature heating. However, such a temperature of the low-temperature heating cannot make the flammable substance to be combusted. If the control component 3 of the electronic cigarette detects the initiated state and detects that the cartridge is inserted into the cigarette pocket 9, the heating temperature of the heat generating sheet 2 is controlled to be the second temperature, so as to cure the cartridge at a high temperature, so that the cartridge produces smoke.

It is exemplarily explained that when the user unintentionally pushes the cap of the cigarette pocket 1 of the electronic cigarette open, the trigger signal is sent out, and the heat generating sheet 2 performs the low-temperature heating under the control of the control component 3. Such a temperature of the low-temperature heating cannot make the flammable substance to be combusted, and even if the heat generating sheet 2 contacts with the flammable substance, safety hazards of a fire will not be caused. When the user wants to smoke the electronic cigarette, the electronic cigarette is initiated to work by pushing the cap of the cigarette pocket 1, and the heat generating sheet 2 performs the low-temperature heating under the control of the control component 3; when the user inserts the cartridge into the cigarette pocket 9 of the electronic cigarette, the control component 3 detects the insertion of the cartridge, and controls the heat generating sheet 2 to heat the cartridge at the high temperature, so that the cartridge produces atomized substances, and the user can smoke by sucking a mouthpiece of the cartridge.

In this way, a working state of the electronic cigarette may be controlled by the cap of the cigarette pocket; when the electronic cigarette is in the initiated state, the electronic cigarette is in a low-temperature heating state, and the temperature cannot make the flammable substance to be combusted; when the cartridge is inserted into the cigarette pocket, the electronic cigarette is in a high-temperature heating state, thereby when the electronic cigarette is carried, avoiding safety hazards of a fire brought by an unintentional trigger of an initiation switch in case a flammable substance is brought into contact with the heating element of the electronic cigarette, and improving the usage safety of the electronic cigarette.

Alternatively, the shell 4 of the electronic cigarette is provided with a slide rail 5, and the cap 1 of the cigarette pocket is disposed on the slide rail 5 to move along a slide groove of the slide rail 5. When the cap 1 of the cigarette pocket slides to a preset position of the slide rail 5, a notch of the cigarette pocket 9 is covered.

Alternatively, the cap 1 of the cigarette pocket and the slide rail 5 may be disposed on top of the electronic cigarette, or may be disposed on any side of the electronic cigarette. The notch is an open vent for placing the cartridge on the cigarette pocket 9, and the preset position may be a position at which the cap 1 of the cigarette pocket overlaps with the open vent for placing the cartridge on the cigarette pocket 9.

Alternatively, a first induction component 6 is disposed on a side of the cap 1 of the cigarette pocket facing towards the electronic cigarette, and a second induction component 7 is disposed in the electronic cigarette. During the cap 1 of the cigarette pocket sliding on the slide rail 5, the electronic cigarette is triggered to be in the initiated state, when a position of the first induction component 6 corresponds to a position of the second induction component 7 to induct with each other.

Alternatively, the electronic cigarette further includes a magnet 13. The first induction component 6 and the second induction component 7 forms an induction switch together. This induction switch may be any one of a Hall induction switch, an optical switch, a contact switch, a capacitive induction switch or the like. Correspondingly, the first induction component 6 and the second induction component 7 are two induction parts that constitute any one of the above induction switches.

Exemplarily, if the induction switch is the Hall induction switch, the first induction component 6 may be a Hall magnet, the second induction component 7 may be a Hall switch, and the magnet 13 is used in cooperation with the second induction component 7. In a process during which the cap 1 of the cigarette pocket moves from a position away from the notch of the cigarette pocket 9 to a position where the notch of the cigarette pocket 9 is covered, or when the position of the first induction component 6 corresponds to the position of the second induction component 7 and the induction occurs, a magnetic field will be changed, the Hall switch senses a change of the magnetic field and outputs a high voltage level or a low voltage level, and the control component 3 senses a voltage level change and detects whether the electronic cigarette is in the initiated state or the standby state.

Figure 5:
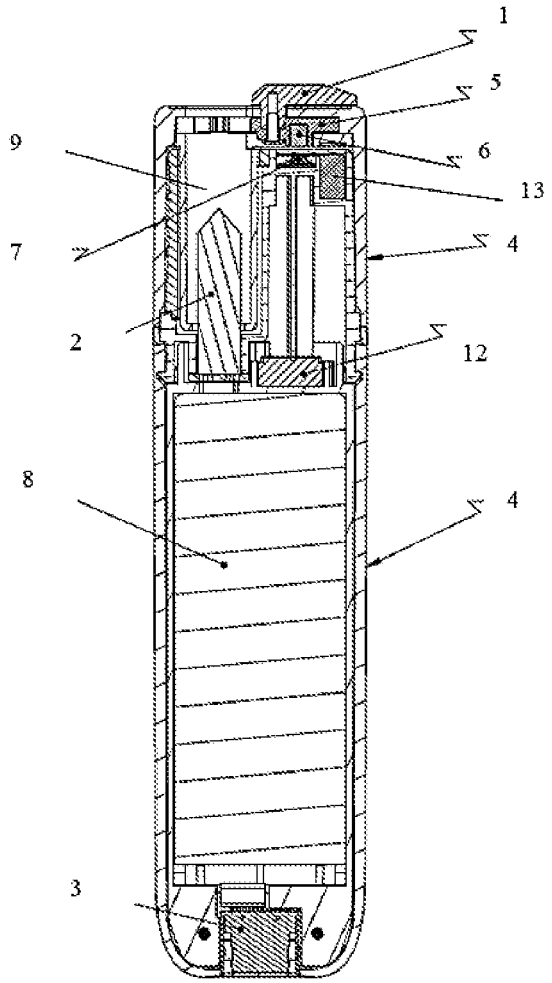
FIG. 5 is another schematic diagram of an internal structure of an electronic cigarette according to an embodiment three of the present disclosure.

It is exemplarily explained in conjunction with FIG. 4 that when the electronic cigarette is not in use, the cap 1 of the cigarette pocket covers the notch of the cigarette pocket 9 to seal the notch, that is, the first induction component 6 does not move and the position of the first induction is staggered with the position of the second induction component 7 and no induction occurs, so that the second induction component 7 does not sense a change of the magnetic field, the output voltage level remains unchanged, and the control component 3 controls the electronic cigarette to be in the standby state. FIG. 5 is another schematic diagram of an internal structure of an electronic cigarette according to the embodiment three of the present disclosure. Referring to FIG. 5, if the cap 1 of the cigarette pocket drives the first induction component 6 to slide to a position corresponding to the position of the second induction component 7 and the induction occurs, the second induction component 7 senses the change of the magnetic field, the output voltage level also changes, and the control component 3 senses the voltage level change and triggers the electronic cigarette to be in the initiated state. If the user finishes using the electronic cigarette, pulls the cartridge out of the electronic cigarette, and pushes the cap 1 of the cigarette pocket to slide on the slide rail 5, in a process during which the cap of the cigarette pocket 1 moves from the position away from the notch of the cigarette pocket 9 to the position where the notch of the cigarette pocket 9 is covered, the position of the first induction component 6 is staggered with the position of the second induction component 7 and the induction disappears, the second induction component 7 senses the change of the magnetic field, the output voltage level also changes, and the control component 3 senses the voltage level change and controls the electronic cigarette to be in the standby state.

Alternatively, the electronic cigarette further includes a battery component 8. The battery component 8 is electrically connected to the second induction component 7, the heat generating sheet 2 and the control component 3 separately. When the first induction component 6 inducts with the second induction component 7, the battery component 8 supplies power to the heat generating sheet 2 and the control component 3.

Alternatively, the control component 3 is further configured to control the battery component 8 to stop supplying power to the heat generating sheet 2 and the control component 3, when the control component 3 fails to detect that the cartridge is inserted into the cigarette pocket 9 within the preset duration during which the electronic cigarette is in the initiated state. The battery component 8 may be a storage battery or other batteries, and supplies power to the second induction component 7, the heat generating sheet 2 and the control component 3.

It is exemplarily explained that when the user pushes the cap 1 of the cigarette pocket to drive the first induction component 6 to slide on the slide rail 5, if the position of the first induction component 6 corresponds to the position of the second induction component 7 to induct with each other, the electronic cigarette is in the initiated state, the battery component 8 supplies power to the second induction component 7, the heat generating sheet 2 and the control component 3, so as to ensure that the electronic cigarette is in the initiated state, and the control component 3 normally controls the heat generating sheet 2 to perform the low-temperature heating; if the cap 1 of the cigarette pocket is unintentionally pushed open, the position of the first induction component 6 corresponds to the position of the second induction component 7, and the induction occurs, but the user has not inserted the cartridge within the preset duration, the battery component 8 stops supplying power to the heat generating sheet 2 and the control component 3, so that the electronic cigarette is in the standby state to save power.

Alternatively, the control component 3 is further configured to detect temperature values of two ends of the heat generating sheet 2, and determine that the cartridge is inserted into the cigarette pocket 9 of the electronic cigarette when the temperature values decrease.

Alternatively, the control component 3 is further configured to control the heat generating sheet to generate heat based on certain power within a preset interval, acquire a temperature changing period of the heat generating sheet, and determine that the cartridge exists in the cigarette pocket of the electronic cigarette when the temperature changing period extends.

Exemplarily, when the electronic cigarette is initiated, the control component 3 controls the heat generating sheet 2 to heat. If the user inserts a cartridge into the cigarette pocket, the heat generating sheet 2 will transfer part of the heat to the cartridge, and at this time, the temperature of the heat generating sheet 2 decreases. The control component 3 detects that the temperature values at two ends of the heat generating sheet 2 decrease and determines that the cartridge is inserted into the cigarette pocket 9. Alternatively, it is preset that the heat generating sheet 2 is controlled to generate heat based on the certain power within the preset interval, so that the heat generating sheet 2 generates temperature increase and decrease processes. If the user inserts the cartridge into the cigarette pocket, the heat generating sheet 2 transfers part of the heat to the cartridge, time for the temperature to be increased or decreased will become longer, and the control component 3 may detect the existence of the cartridge through a longer temperature period or a temperature slope.

As shown in FIG. 4, the electronic cigarette further includes a fixing member 10, a cavity 11 and a vibration motor 12. The fixing member 10 is configured to fix any component of the electronic cigarette, for example, the vibration motor 12, the heat generating sheet 2, etc., and the cavity 11 is configured to transfer atomized substances or hold other components (not shown in the figure). The vibration motor 12 is electrically connected to the battery component 8 and the control component 3 separately, and the vibration motor 12 is configured to vibrate under the control of the control component 3. Alternatively, the vibration motor 12 may vibrate in any one of following cases, for example, when a battery is fully charged, when the battery has low power, when heating begins, when the heating is ready for use, and when the cartridge is used up, so as to add an additional reminder function. Preferably, when the trigger signal is received, a prompt device is controlled to send out a prompt to prompt the user that the electronic cigarette has been initiated. If the trigger signal is triggered by the user by mistake, the user may reset the cap 1 of the cigarette pocket according to the prompt.

This embodiment provides an electronic cigarette. The working state of the electronic cigarette is controlled through the cap of the cigarette pocket; when the electronic cigarette is in the initiated state, the electronic cigarette is in the low-temperature heating state, and the temperature cannot make the flammable substance to be combusted; when it is detected that the cartridge is inserted into the cigarette pocket, the electronic cigarette is in the high-temperature heating state, thereby when the electronic cigarette is carried, avoiding safety hazards of a fire brought by an unintentional trigger of an initiation switch in case a flammable substance is brought into contact with the heating element of the electronic cigarette, and improving the usage safety of the electronic cigarette.

Embodiment Four

Figure 6:
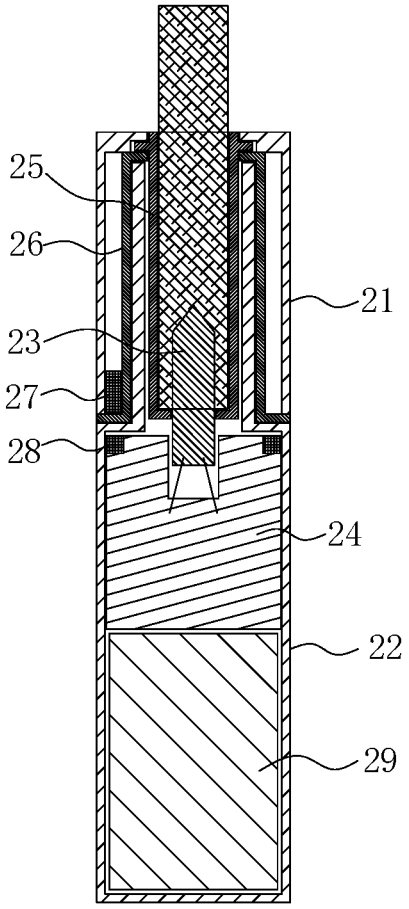
FIG. 6 is a schematic diagram of an internal structure of an electronic cigarette according to an embodiment four of the present disclosure.

FIG. 6 is a schematic diagram of an internal structure of an electronic cigarette according to an embodiment four of the present disclosure. As shown in FIG. 6, the electronic cigarette includes an upper shell 21, a lower shell 22, a heat generating sheet 23 and a control component 24.

The upper shell 21 and the lower shell 22 are rotatable relative to each other around a common rotation axis to generate a trigger signal. The upper shell 21 and the lower shell 22 may be coaxial cylindrical structures, and may rotate relative to each other around the common rotation axis. In an embodiment, the lower shell 22 is fixed, and the upper shell 21 may rotate around the common rotation axis to generate the trigger signal, so that the control component 24 controls a heating temperature of the heat generating sheet 23 to be a first temperature.

The heat generating sheet 23 is disposed inside a cigarette pocket 25 of the electronic cigarette, and configured to generate heat. The control component 24 is electrically connected to the heat generating sheet 23, and configured to: after receiving the trigger signal, detect whether a cartridge is inserted into the cigarette pocket 25 of the electronic cigarette, and when it is determined that no cartridge exists in the cigarette pocket 25, control the heating temperature of the heat generating sheet 23 to be maintained at the first temperature. The first temperature is lower than a second temperature, and the second temperature is a heating temperature of the heat generating sheet 23 when a user smokes the electronic cigarette. In the embodiments of the present disclosure, the electronic cigarette is a heating non-combustion electronic cigarette. When the user smokes, the heat generating sheet cures tobacco in the cartridge to the second temperature instead of combusting the tobacco, where the second temperature is a temperature enough for the tobacco to emit flavor and generally within a range of 250° C. to 450° C., so as to avoid health hazards to the user caused by harmful substances (tar) and particles generated in a case of combusting the tobacco at a high temperature. The first temperature is lower than the second temperature. Exemplarily, the first temperature may be any temperature between a normal temperature to 100. This temperature range is lower than an ignition point of a flammable substance. Even if the heat generating sheet contacts with a flammable substance, safety hazards of a fire will not be caused. A method for detecting whether the cartridge is inserted into the cigarette pocket of the electronic cigarette has been described in detail in the embodiment one of the present disclosure, which will not be repeated here.

The heat generating sheet 23 may be any one of a positive temperature coefficient thermistor, a negative temperature coefficient thermistor or the like, and the control component 24 may be any one of an integrated circuit board, a printed circuit board, a control chip or the like.

Exemplarily, the rotation of the upper shell 21 in this embodiment may send out the trigger signal. When the upper shell 21 is rotated by a certain angle (such as 30°), the trigger signal is sent out, the electronic cigarette is in an initiated state, and the control component 24 detects the initiated state, and controls the heating temperature of the heat generating sheet 23 to be the first temperature for performing the low-temperature heating. However, such a temperature for the low-temperature heating cannot make a flammable substance to be combusted. If the control component 24 of the electronic cigarette detects the initiated state and detects that the cartridge is inserted into the cigarette pocket 25, the heating temperature of the heat generating sheet 23 is controlled to be the second temperature to heat the cartridge at a high temperature, so that the cartridge produces smoke.

It is exemplarily explained that when the user unintentionally rotates the upper shell 21, the trigger signal is sent out, and the heat generating sheet 23 performs the low-temperature heating under the control of the control component 24. Such a temperature for the low-temperature heating cannot make a flammable substance to be combusted, and even if the heat generating sheet 23 contacts with the flammable substance, safety hazards of a fire will not be caused. When the user wants to smoke the electronic cigarette, the electronic cigarette starts to work by rotating the upper shell 21, and the heat generating sheet 23 performs the low-temperature heating under the control of the control component 24; when the user inserts the cartridge into the cigarette pocket 25 of the electronic cigarette, the control component 24 detects the insertion of the cartridge, and controls the heat generating sheet 23 to heat the cartridge at the high temperature, so that the cartridge produces atomized substances, and the user may smoke by sucking a mouthpiece of the cartridge.

In this way, a working state of the electronic cigarette may be controlled through the upper shell; when the electronic cigarette is in the initiated state, the electronic cigarette is in the low-temperature heating state, and the temperature cannot make a flammable substance to be combusted; when a cartridge is inserted into the cigarette pocket, the electronic cigarette is in the high-temperature heating state, thereby when the electronic cigarette is carried, avoiding safety hazards of a fire brought by an unintentional trigger of an initiation switch in case a flammable substance is brought into contact with the heating element of the electronic cigarette, and improving the usage safety of the electronic cigarette.

Alternatively, the electronic cigarette further includes an upper cover bracket 26, a first trigger member 27 and a second trigger member 28. The upper shell 21 is sleeved on the upper cover bracket 26, a gap exists between the upper shell 21 and the upper cover bracket 26, the first trigger member 27 is disposed in the gap, and the second trigger member 28, in correspondence to the first trigger member 27, is disposed on the lower shell 22.

Exemplarily, as shown in FIG. 6, the upper cover bracket 26 has a radius slightly smaller than a radius of the lower shell 22, so that when the upper shell 21 is sleeved on the upper cover bracket 26, an outer surface of the upper shell 21 and an outer surface of the lower shell 22 may be smoothly transitioned. A top end of the upper cover bracket 26 is connected to the upper shell 21, and the upper shell 21 may rotate at the connection. The upper cover bracket 26 is recessed inwards to form the cigarette pocket 25, and at least a part of the heat generating sheet 23 is disposed inside the cigarette pocket 25. The gap exists between an inner side wall of the upper shell 21 and the upper cover bracket 26, and the first trigger member 27 is disposed in the gap and fixed on the inner side wall of the upper shell 21. The second trigger member 28, in correspondence to the first trigger member 27, is disposed on the lower shell 22.

When the upper shell 21 rotates relative to the lower shell 22, a position of the first trigger member 27 changes accordingly, and the second trigger member 28 senses a position change, then generates the trigger signal, and sends the trigger signal to the control component 24.

Alternatively, in this embodiment, the first trigger member 27 includes a magnet or an optical signal transmitter; and the second trigger member 28 includes a Hall sensor or an optical signal receiver. When the rotation of the upper shell 21 leads to a position change of the first trigger member 27, the second trigger member 28 senses the position change, then generates the trigger signal, and sends the trigger signal to the control component 24. In an embodiment, the optical signal transmitter and the optical signal receiver are generally integrated as the first trigger member or the second trigger member, then the second trigger member or the first trigger member at this time may be a reflector, and an optical signal transmitted by the optical signal transmitter is received by the optical signal receiver after being reflected by the reflector.

It is to be noted that in the embodiments of the present disclosure, the forms of the first trigger member and the second trigger member are illustrative and not limitative of the present disclosure. The first trigger member is not limited to the magnet or the optical signal transmitter described in the above embodiment, and the second trigger member is not limited to the Hall sensor or the optical signal receiver. For example, the first trigger member is electrically contacted with the second trigger member, and the second trigger member is configured to detect a resistance change in a case of the position change and then generate the trigger signal.

Alternatively, the upper shell 21 and the lower shell 22 rotate relative to each other around the common rotation axis by a specified angle to generate the trigger signal which corresponds to the specified angle, and the control component is configured to select, according to the trigger signal, a heating curve corresponding to the specified angle to control the heat generating sheet 23 to heat according to the heating curve.

Exemplarily, when the upper shell 21 rotates by 45°, the second trigger member 28 generates a trigger signal, and the control component 24 selects a first heating curve according to this trigger signal to control the heat generating sheet 23 to heat according to the first heating curve. When the upper shell 21 rotates by 60°, the second trigger member 28 generates a trigger signal, and the control component 24 selects a second heating curve according to this trigger signal to control the heat generating sheet 23 to heat according to the second heating curve. When the user selects different heating curves to heat the cartridge, there will be different tastes for smoking, thereby satisfying diversified requirements of users.

Of course, in other embodiments of the present disclosure, the upper shell 21 may rotate by different angles to achieve other functions, for example, initiation of a Bluetooth connection to enable the electronic cigarette to establish the Bluetooth connection with a mobile device. Examples are not given one by one in the embodiments of the present disclosure.

Alternatively, the electronic cigarette further includes a return member (not shown in the figure). The return member is disposed between the upper shell 21 and the lower shell 22, the return member may be disposed at the connection of the upper shell 21 and the lower shell 22. The return member may be a spring with elastic resilience to enable the upper shell 21 to return to an initial position after rotating relative to the lower shell 22.

The electronic cigarette further includes a battery component 29. The battery component 29 is electrically connected to the second trigger member 28, the heat generating sheet 23 and the control component 24 separately. The battery component 29 may be a storage battery or other batteries, and supplies power to the second trigger member 28, the heat generating sheet 23 and the control component 24.

Alternatively, the control component 24 is further configured to control the battery component 29 to stop supplying power to the heat generating sheet 23 and the control component 24 when it fails to detect that the cartridge is inserted into the cigarette pocket 25 within the preset duration during which the electronic cigarette is in the initiated state.

It is exemplarily explained that when the user rotates the upper shell 21 to drive the first trigger member 27 to rotate by 30°, the second trigger member 28 sends the trigger signal to the control component 24, the control component 24 controls the electronic cigarette to enter the initiated state, and the battery component 29 supplies power to the heat generating sheet 23 to ensure that the electronic cigarette is in the initiated state, and the control component 24 normally controls the heat generating sheet 23 to perform the low-temperature heating; if the upper shell 21 is unintentionally rotated to initiate the electronic cigarette, but the user has not inserted a cartridge within a preset duration, the control component 24 controls the battery component 29 to stop supplying power to the heat generating sheet 23, so that the electronic cigarette is in the standby state to save power.

Alternatively, the control component 24 is further configured to detect temperature values of two ends of the heat generating sheet 23, and determine that the cartridge is inserted into the cigarette pocket 25 of the electronic cigarette when the temperature values decrease.

Alternatively, the control component 24 is further configured to control the heat generating sheet to generate heat based on certain power within a preset interval, acquire a temperature variation period of the heat generating sheet, and determine that the cartridge exists in the cigarette pocket of the electronic cigarette when the temperature variation period extends.

Exemplarily, when the electronic cigarette is initiated, the control component 24 controls the heat generating sheet 23 to heat. If the user inserts the cartridge into the cigarette pocket, the heat generating sheet 23 will transfer part of the heat to the cartridge, and the temperature of the heat generating sheet 23 decreases at this time. The control component 24 detects that the temperature values at two ends of the heat generating sheet 23 decrease and determines that the cartridge is inserted into the cigarette pocket 25. Alternatively, it is preset that the heat generating sheet 23 is controlled to generate heat based on the certain power within the preset interval, so that the heat generating sheet 23 generates temperature increasing and decreasing processes. If the user inserts the cartridge into the cigarette pocket, the heat generating sheet 23 transfers part of the heat to the cartridge, the time for the temperature to be increased or decreased will become longer, and the control component 24 may detect the existence of the cartridge through a longer temperature period or a temperature slope.

It is to be noted that the above are merely alternative embodiments of the present disclosure and the technical principles used therein. It is to be understood by those skilled in the art that the present disclosure is not limited to the embodiments described herein. Those skilled in the art can make various apparent modifications, adaptations and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. An electronic cigarette, comprising: an upper shell, a lower shell, a heat generating sheet and a control component; wherein the upper shell and the lower shell are rotatable relative to each other around a common rotation axis to generate a trigger signal;

the heat generating sheet is disposed inside a cigarette pocket of the electronic cigarette, and the heat generating sheet is configured to generate heat; and the control component is electrically connected to the heat generating sheet, and the control component is configured to: after receiving the trigger signal, detect whether a cartridge exists in the cigarette pocket of the electronic cigarette, and in response to determining that no cartridge exists in the cigarette pocket, control a heating temperature of the heat generating sheet to be maintained at a first temperature; wherein the first temperature is lower than a second temperature, and the second temperature is a heating temperature of the heat generating sheet in a case of a user smoking the electronic cigarette;

wherein the electronic cigarette further comprises: an upper cover bracket, a first trigger member and a second trigger member, wherein the upper shell is sleeved on the upper cover bracket, a gap exists between the upper shell and the upper cover bracket, the first trigger member is disposed in the gap, and the second trigger member, in correspondence to the first trigger member, is disposed on the lower shell; and in a case where the upper shell rotates relative to the lower shell, the first trigger member or the second trigger member generates the trigger signal.

2. The electronic cigarette of claim 1, wherein the first trigger member comprises a magnet or an optical signal transmitter; and the second trigger member comprises a Hall sensor or an optical signal receiver.

3. The electronic cigarette of claim 1, wherein the upper shell and the lower shell rotate relative to each other around the common rotation axis by a specified angle to generate the trigger signal which corresponds to the specified angle, and the control component is configured to select, according to the trigger signal, a heating curve corresponding to the specified angle to control the heat generating sheet to heat according to the heating curve.

4. The electronic cigarette of claim 1, further comprising: a return member, wherein the return member is disposed between the upper shell and the lower shell to enable the upper shell to return to an initial position after the upper shell rotates relative to the lower shell.

* * * * *